US005195570A

United States Patent [19]

Marocco

[11] Patent Number: 5,195,570

[45] Date of Patent: Mar. 23, 1993

[54] BRACKET FOR WINDOW COVERING ASSEMBLY

[76] Inventor: Norbert Marocco, 46 Pennycross Ct., Woodbridge, Ontario, Canada, L4L 3M6

[21] Appl. No.: 883,275

[22] Filed: May 14, 1992

[51] Int. Cl.[5] ..... A47H 1/14

[52] U.S. Cl. ..... 160/178.1; 16/94 R; 160/902; 248/262

[58] Field of Search ..... 248/262, 544, 251, 264, 248/261, 222.1, 223.3, 225.2; 160/178.1, 902; 16/94 R

[56] References Cited

U.S. PATENT DOCUMENTS

| | | | |
|---|---|---|---|
| 2,698,727 | 1/1955 | Rutledge | 160/902 X |
| 4,475,706 | 10/1984 | Anderson | 16/94 R |
| 4,607,818 | 8/1986 | Georgopoulos | 248/544 X |
| 4,718,625 | 1/1988 | Boda | 248/222.1 |
| 4,802,644 | 2/1989 | Oskam | 248/251 |
| 4,949,926 | 8/1990 | Liu | 16/94 R |
| 5,042,553 | 8/1991 | Schaffer | 248/251 X |
| 5,074,350 | 12/1991 | Carter | 160/902 X |

*Primary Examiner*—J. Franklin Foss

[57] ABSTRACT

Support brackets for use with a window covering having a head rail head rail, each support bracket having a generally horizontal body defining forward and rear edges, an attachment plate for securing the body to a building, forward engagement members formed on the body member, and engageable with a forward edge of the head rail, a clamp slideably supported by the body slideable between forward and rearward positions, a clamping hook on the clamp adjacent a rearward end engageable with the rearward side of the head rail, when the clamping member is moved rearwardly, the forward edge of the clamp being manually moveable so that it may be manually operated to and fro, and an interlock interengageable between the clamp and the body to hold them locked in the rearward position.

3 Claims, 2 Drawing Sheets

BRACKET FOR WINDOW COVERING ASSEMBLY

FIELD OF THE INVENTION

The invention relates to a bracket device for supporting a window covering assembly and, in particular, to a bracket device for supporting a window covering assembly of the type having a horizontal head rail from which a window covering is supported.

BACKGROUND OF THE INVENTION

Window coverings have been available for many years based on a design incorporating a generally horizontal rigid head rail from which some form of mechanical blind or window covering or drapery is supported. It is necessary to provide some form of means for supporting the head rail in the desired location, usually in registration with or above a window. Typically, the head rail will be supported either on the window frame, the wall, or even the ceiling.

Various forms of support devices have been provided in the past. Some such support devices engage the head rail at either end. However, another class of support device provides two or more brackets which may be secured in position to the building fabric, and to which the head rail may be secured at spaced apart points intermediate its two ends. These brackets may have advantages in certain circumstances. It may improve the aesthetic appearance of the blind in some cases. In other cases, it may be more convenient to use such supporting brackets, rather than the end supporting devices used with some makes of blinds.

In the design of such supporting brackets, it is highly desirable that the brackets shall be so arranged that they may be secured to the building fabric, at spaced intervals, in a first operation. The brackets preferably incorporate some form of moveable clamping device interengageable with the head rail, so that in a second operation the head rail is simply raised into position, and the clamping devices are operated thereby clamping the head rail to the supporting brackets.

Various different forms of such supporting brackets incorporating such clamping devices are in fact known. It is however desirable from the viewpoint of economy that such supporting bracket devices shall be of extreme simplicity and design, and yet shall be functional so as to provide for a secure rigid clamping of the head rail to the support bracket when the clamping portion of the bracket is closed, and also to provide some form of interlock device holding the clamping portion of the bracket closed, so that it does not inadvertently become shaken loose and open up during use of the blind. If this should occur, the blind may then be simply free to fall down with the result that there may be possible damage to the blind, and even injury or at the very least inconvenience to a user of the blind.

In addition, it is desirable that it shall be provided with attachment means whereby it may be attached either to a vertical surface such as a window frame or a wall, or to a horizontal surface such as a ceiling, and that in either case the clamping device shall be readily operable. It is also desirable that it shall be of such a design that it is substantially concealed from view being either behind or above the head rail, in this way when viewed by persons standing in the room, the support brackets are virtually entirely out of sight.

BRIEF SUMMARY OF THE INVENTION

With a view to satisfying these various conflicting objectives, the invention comprises a support bracket apparatus for use in association with a window covering device having a head rail, said head rail having forward and rear edge portions, said supporting apparatus being adapted to be spaced apart from one another a predetermined distance along said head rail, and said support bracket apparatus comprising a generally horizontal body portion defining forward and rear edges, attachment means for securing said body portion to a building fabric, forward engagement members formed on said body member, and engageable with a forward edge of said head rail, a clamp member slideably supported by said body member and slideable between respective forward and rearward positions, and clamping hook means on said clampingmember adjacent a rearward end thereof engageable with said rearward side of said head rail, when said clamping member is moved rearwardly, manually engageable means adjacent a forward edge of said clamping member whereby the same may be manually operated to and for, and interlock means interengageable between said clamping member and said body member, whereby to hold the same locked in said rearward position.

The invention further comprises such a support apparatus wherein said rearward hook portion comprises an angled ramp surface, interengageable with said rearward edge of said head rail, whereby progressive rearward movement of said clamping member increases the clamping force on the head rail.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
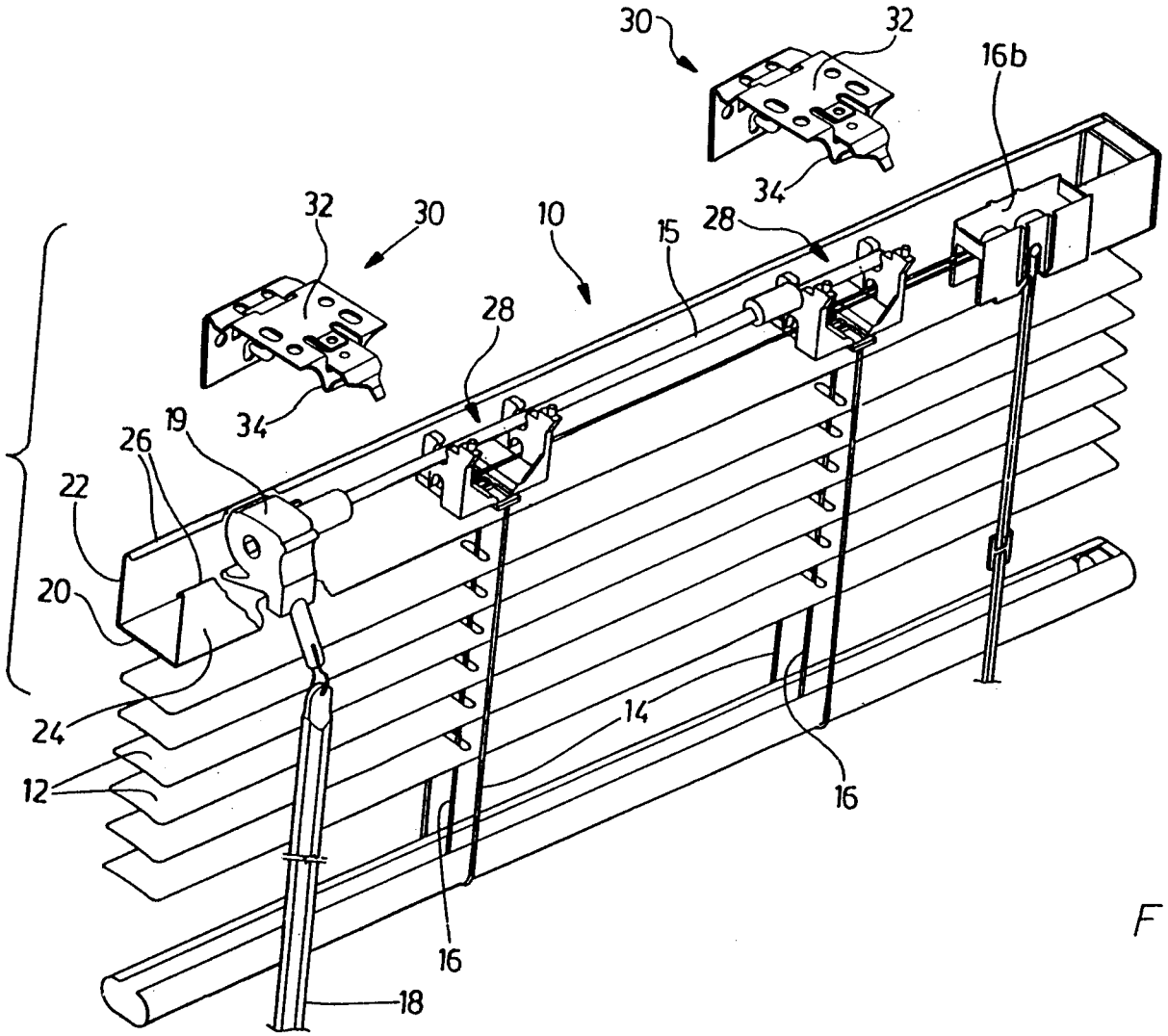
FIG. 1 is a perspective illustration of a typical venetian blind window covering, showing two of the support brackets in accordance with the invention, in exploded form.

Referring first of all to FIG. 1, it will be seen that this drawing illustrates a typical window covering assembly, in this case, for the sake of illustration only, it is a venetian blind. Other window coverings can also use the invention, with advantage. Typical venetian blinds comprise a head rail indicated as 10, and a plurality of generally horizontal blind slats 12 suspended below the head rail 10. Typically the blind will have ladder tapes 14—14, for carrying individual slats in spaced apart locations connected to shaft 15. Typical blinds will further have raise cords 16—16 passing through suitable openings in the blind slats. By means of suitable controls (not shown), the blind slats can be raised and lowered and can also be tilted. Tilting is usually performed rotating shaft 15 by means of a hand control such as the wand 18 and gear device 19. Raising and lowering is usually performed by means such as the raise cords 16*a*, which are controlled by means of a suitable cord locking mechanism (the details of which are well known in the art and require no description).

As in the great majority of window covering devices of this type, the head rail comprises a generally u-shaped channel having a bottom wall 20, and a rear side wall 22, and a front side wall 24, and an open top.

Rear and front walls 22 and 24 are provided with inturned lips 26—26, for reasons to be explained below.

Figure 2:
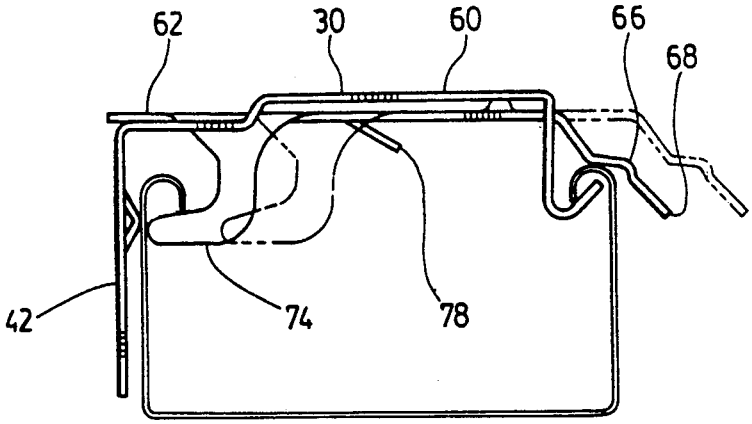
FIG. 2 is a side elevation of the support bracket of FIG. 1.
Figure 3:
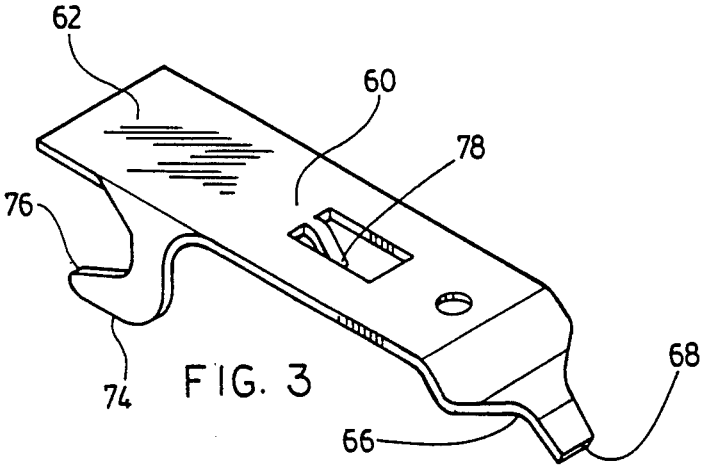
FIG. 3 is a side elevation of the clamping member of the support bracket.
Figure 4:
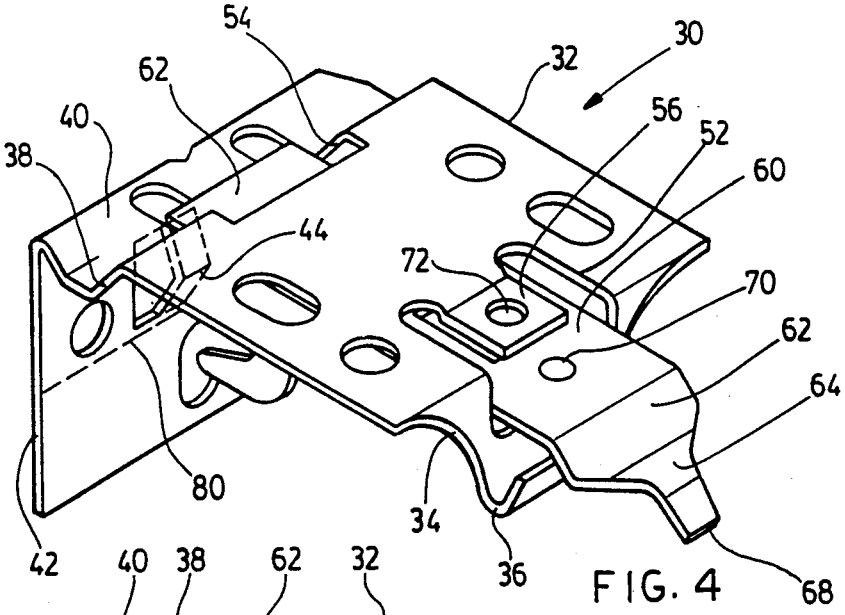
FIG. 4 is an enlarged perspective illustration of the support bracket of FIGS. 1 and 2, showing movement thereof in phantom, and, FIG. 5 is a rear elevation of an alternate embodiment.
Figure 5:
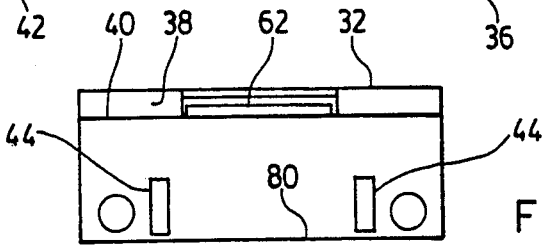

The support brackets in accordance with the present invention are illustrated generally in FIG. 1, in exploded form, by the reference 30. As best shown in FIGS. 2, 3, and 4, the support brackets 30 comprise a top support panel member 32, adapted to substantially span the open top of the head rail 10. Along the forward or leading edge of the panel member 32, there is a downwardly dependent angular flange 34 generally at about a right angle. Along the free edge of flange 34, there is an upturned hook portion 36. Hook portion 36 is adapted to fit under the inturned lip 26 on the front wall 24 (see FIG. 2).

Panel member 32 along its rearward edge has a downwardly dependent angular flange 38 generally at about a right angle which is, in turn, connected to a rearwardly extending plate portion 40.

In the embodiment of FIG. 4, the bracket 30 is intended to be adapted for mounting on a vertical surface such as a wall, or on a window frame. For this purpose it has a mounting plate 42 attached to the rearwardly extending plate portion 40 substantially at right angles. Any suitable arrangement of openings indicated generally as 44 are provided in the plate 42, for the reception of suitable fastenings (not shown) in well known manner.

Preferably, in accordance with the invention, there are two or more generally wedge-shaped indented grooves 46—46 formed at the junction between plate portion 40 and plate 42 for reasons to be described.

Along the lower edge of rearward fastening plate 42, there is a forwardly extending edge flange 48 which is, in turn, formed with an upwardly extending hook portion 50.

The dimensions of the panel 32 in the flanges 34 and 40 and 42 are such that they will permit the head rail 10 to be placed in position in nesting relationship as shown in FIG. 2.

Referring once again to FIG. 4, the clamping portion of the bracket 30 will now be described.

As shown in FIG. 4, it will be observed that the panel 32 is formed with a forwardly directed generally rectangular opening 52 and a rearwardly directed generally rectangular opening 54, the two openings registering along a central axis of panel 32. Openings 52 and 54 extend downwardly into respective flanges 34 and 38.

A locking tab portion 56 is formed integrally with panel portion 32 and extends partially into the opening 52 for reasons to be described.

The clamping member itself comprises a generally elongated rectangular shaped clamping bar 60, having a rearward end 62 extending through opening 54, and adapted to overlie plate portion 40.

Clamping bar 60 has a forward end defined by a downwardly dependent flange 64, and a forwardly extending plate portion 66, and a manually engageable handle portion 68.

A recess 70 is formed in bar 60, engageable with a detent 72 formed in tongue 56.

Referring now to FIGS. 2 and 3, the clamping bar member 60 will be seen to be provided with a rearwardly downwardly dependent locking hook 74. Hook portion 74 has an upwardly rearwardly directed wedging surface 76 for reasons to be described below.

Bar 60 is also provided with a forwardly and downwardly directed stop member 78 for reasons to be described below.

In operation, the two or more support brackets 30—30 are first of all fastened to the building fabric by suitable fastenings. These may typically be passed through the back panel 42, if the window covering is to be erected on the window frame or the wall.

However, they may equally well be passed through suitable openings in the top panel (FIG. 4) if it is desired to secure the blind as close as possible to the ceiling.

The two clamping bars 60 are then drawn forwardly, i.e., withdrawn outwardly to their maximum extent. The head rail 10 of the window covering assembly is then placed in nesting relation, underneath the top panel 32. The inturned lip 26 on the leading or front wall 24 of the head rail is then engaged over the upturned hook portion 36 on the front of the downwardly dependent flange 34. When securely placed in position, the dimensions of the head rails are such that the rear wall 22 will lie against the indented grooves 46 in the mounting plate 42.

The clamping bars 60 are then manually pushed rearwardly. This will then bring the locking hooks 74 into engagement with the inturned lip 26 on the rear wall 22. The wedging surfaces 76 of the hooks 74 as they are forced into tighter and tighter engagement with the inturned lip, will force the lip upwardly and backwardly at the same time.

Eventually, the detents 72 will register with the recesses 70, thereby providing a fictional lock holding the clamping bars in their rearward positions.

If, at any time it is necessary to remove the window covering, then the clamping bar 68 is simply grasped with a finger and thumb, or suitable tool such as a pair of pliers and pulled outwardly. The stop member 78 will limit the outward movement of the clamping bars. As the clamping bars are moved outwardly, they will release the inturned lips 26 on the rearward wall 22 of the head rail, and the head rail can then be disengaged from the hooks at the front, and removed.

In an alternate embodiment as illustrated in FIG. 4, the mounting plate 42 may be dispensed with if, for example, the supporting brackets are required only for fastening to a downwardly facing surface such as the inside of a window frame, or the ceiling.

In this case, as indicated by the phantom line 80, the mounting panel 42 may simply be omitted during manufacture.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A support bracket apparatus for use in association with a window covering device having a head rail, said head rail having forward and rear edge portions, said support bracket apparatus being adapted to be spaced apart from one another a predetermined distance along said head rail, and said support bracket apparatus comprising:

a generally horizontal body portion defining forward and rear edges;

attachment means for securing said body portion to a building fabric;

forward engagement means formed on said body member, and engageable with a forward edge of said head rail said forward engagement means having a forwardly extending hook portion formed integrally with said generally horizontally body portion, and defining a hook like shape in section, open upwardly, to receive a forward edge portion of said head rail;

a generally planar clamp member slideably supported by said body member and slideable between respective forward and rearward positions;

downwardly dependent rearwardly facing clamping hook means on said clamp member adjacent a rearward end thereof interengageable with said rearward edge portion of said head rail, when said clamp member is moved rearwardly said hook means having an angled ramp surface, whereby progressive rearward movement of said clamp member increases the clamping force on said head rail;

opening means in said body portion for receiving said clamp member, whereby the same may be slid to and fro relative to the said body portion for clamping engagement as aforesaid;

manually engageable means adjacent a forward edge of said clamp member whereby the same may be manually operated to and fro, and, interlock means interengageable between said clamp member and said body member, whereby to hold the same locked in said rearward position.

2. A support bracket apparatus as claimed in claim 1 including a locking tab portion formed integrally with said horizontal body portion, and interlock means formed therein, and complementary mating interlock formations formed in said clamp member, whereby, when said clamp member is slid rearwardly into locking engagement with said rear edge of said head rail, said interlock formations interengage, securing said clamp member in its rearward locking position.

3. A support bracket apparatus as claimed in claim 2, and wherein said generally horizontal body portion defines an upper generally planar forward portion, with said attachment hook means extending downwardly and forwardly therefrom, and a rearward planar portion, and an offset connecting portion connecting said forward and said rearward portion, whereby said rearward portion is located in a plane below the plane of said forward portion, and wherein said opening means for receiving said clamp member include forward opening means located along a forward edge of said forward portion, and further opening means located along said connection flange, whereby said clamp member may slide beneath said forward upper portion, and over said rearward lower portion. w

* * * * *